US011132889B2

(12) United States Patent
McSchooler et al.

(10) Patent No.: US 11,132,889 B2
(45) **Date of Patent: *Sep. 28, 2021**

(54) AUTOMATED CRISIS INCIDENT RESPONSE FOR INTERNET OF THINGS NETWORKS

(71) Applicant: DISH Network L.L.C., Englewood, CO (US)

(72) Inventors: Jeff McSchooler, Parker, CO (US); Max Stephen Gratton, Parker, CO (US)

(73) Assignee: DISH Network L.L.C., Englewood, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/909,022

(22) Filed: Jun. 23, 2020

(65) Prior Publication Data

US 2020/0320850 A1 Oct. 8, 2020

Related U.S. Application Data

(63) Continuation of application No. 16/237,266, filed on Dec. 31, 2018, now Pat. No. 10,733,871.

(51) Int. Cl.

| | |
|---|---|
| ***G08B 25/00*** | (2006.01) |
| ***G08B 25/10*** | (2006.01) |
| ***G08B 13/16*** | (2006.01) |
| ***G08B 27/00*** | (2006.01) |

(52) U.S. Cl.

CPC ..... *G08B 25/006* (2013.01); *G08B 13/1672* (2013.01); *G08B 25/10* (2013.01); *G08B 27/001* (2013.01)

(58) Field of Classification Search

CPC ..... H04M 2203/355; H04M 3/5116; H04W 4/029; H04W 4/90; H04W 4/06; H04W 4/02; G08B 25/016

See application file for complete search history.

(56) References Cited

U.S. PATENT DOCUMENTS

| | | | | |
|---|---|---|---|---|
| 2016/0345153 | A1* | 11/2016 | Adams | H04W 4/90 |
| 2017/0289350 | A1* | 10/2017 | Philbin | G08B 25/016 |
| 2018/0310159 | A1* | 10/2018 | Katz | H04W 4/90 |
| 2019/0130719 | A1* | 5/2019 | D'Amico | G06F 9/451 |
| 2019/0174289 | A1* | 6/2019 | Martin | H04W 4/90 |
| 2019/0320310 | A1* | 10/2019 | Horelik | H04W 4/90 |

* cited by examiner

*Primary Examiner* — Mirza F Alam

(74) *Attorney, Agent, or Firm* — Kilpatrick Townsend & Stockton LLP

(57) ABSTRACT

Novel techniques are described for automated crisis incident response in facilities having networks of Internet of Things (IoT devices). For example, embodiments can operate in context of automatically responding to an active shooter incident in a school. Detection of a gunshot event can trigger embodiments automatically to obtain (e.g., retrieve and/or compute) and execute an automated response plan. Execution of the plan can involve automated control of multiple IoT devices installed in and around the facility, and can be responsive to feedback from the IoT devices. Some embodiments facilitate interaction with crisis responders via a responder network, providing such responders with various levels of information access and/or control of components (e.g., execution of the automated response plan can also be responsive to commands issued by responders.

18 Claims, 4 Drawing Sheets

AUTOMATED CRISIS INCIDENT RESPONSE FOR INTERNET OF THINGS NETWORKS

CROSS-REFERENCES TO RELATED APPLICATIONS

This application claims priority to U.S. patent application Ser. No. 16/237,266, filed on Dec. 31, 2018, entitled "Automated Crisis Incident Response For Internet Of Things Networks," the disclosure of which is hereby incorporated by reference in its entirety for all purposes.

FIELD

This invention relates generally to Internet of Things devices and networks, and, more particularly, to systems and methods for automated crisis incident response that exploit internet of things networks.

BACKGROUND

When there is a crisis incident in a populated area, there is often a high risk of injury or loss of life. For example, an active shooter incident in a school, office, shopping mall, public park, or other area can put many lives in danger. Coordinating a response to a crisis incident that is rapid, efficient, well-planned, and well-executed can appreciably reduce the likelihood of severe injury and loss of life. However, such a coordinated response can be difficult to implement, particularly when the crisis incident is unexpected, and/or when the first responders are not experts in crisis response.

Some organizations develop and coordinate response plans with emergency responders, such as with private security guards, police and fire personnel, medical personnel, and others in an attempt to improve the effectiveness of crisis response in their facilities. Such cases, however, tend to rely on effective and accurate manual intervention, and the effectiveness of such intervention can depend highly on a number of factors. One factor is the training of staff, and/or the availability of trained staff, with respect to the crisis response plans. Another factor is how quickly and/or successfully emergency responders are able to reach and access the facility or facilities in crisis. Another factor is how much and what type of real-time information relating to the crisis is available to those in crisis and those responding to the crisis.

In limited instances, certain sensors can be used to provide an automatic response to a particular type of incident. For example, a fire or power outage may cause fire doors in a building automatically to close. However, such automatic responses tend to be very limited in effectiveness, and typically cannot adapt to multiple types of incidents or to changing parameters of an incident. For example, an automatically closing fire door can impede people's efforts to quickly escape a dangerous incident, and/or emergency responders' efforts to respond to the incident.

BRIEF SUMMARY

Among other things, embodiments provide novel systems and methods for automated crisis incident response in facilities having networks of Internet of Things (IoT devices). For example, embodiments can operate in context of automatically responding to an active shooter incident in a school. Detection of a gunshot event can trigger embodiments automatically to obtain (e.g., retrieve and/or compute) and execute an automated response plan. Execution of the plan can involve automated control of multiple IoT devices installed in and around the facility, and can be responsive to feedback from the IoT devices. Some embodiments facilitate interaction with crisis responders via a responder network, providing such responders with various levels of information access and/or control of components (e.g., execution of the automated response plan can also be responsive to commands issued by responders.

According to one set of embodiments, an automated crisis incident response system is provided. The system includes a crisis detector, an automated response processor, and an IoT controller. The crisis detector is to generate an incident trigger signal in response to detecting that a gunshot detection signal received from a gunshot sensor indicates a gunshot event in a facility having multiple Internet of Things (IoT) devices installed therein. The automated response processor is coupled with the crisis detector to output an IoT control profile generated automatically in response to the incident trigger signal and in accordance with executing an automated response plan. The IoT controller is coupled with the automated response processor to: generate a plurality of IoT control signals automatically in response to the IoT control profile; communicate the IoT control signals to the plurality of IoT devices over an IoT network; and output an IoT status for the plurality of IoT devices in accordance with IoT feedback received from the plurality of IoT devices responsive to the plurality of IoT devices operating in accordance with the IoT control signals. Execution of the automated response plan by the automated response processor is at least partially responsive to the IoT status.

According to another set of embodiments, a method is provided for automated crisis incident response in an Internet of Things (IoT) network. The method includes: receiving, by an automated response processor, an incident trigger signal generated in response to detecting a gunshot event in a facility in accordance with receiving a gunshot detection signal from a gunshot sensor installed in the facility; executing, by the automated response processor, an automated response plan automatically in response to the incident trigger signal, the executing comprising outputting an IoT control profile to cause: generating IoT control signals in accordance with the automated response plan; and communicating the IoT control signals to IoT devices over the IoT network, the IoT devices installed in the facility; and receiving, by the automated response processor, an IoT status for the IoT devices responsive to the IoT devices operating in accordance with the IoT control signals. The executing of the automated response plan by the automated response processor is at least partially responsive to receiving the IoT status.

According to another set of embodiments, another automated crisis incident response system is provided. The system includes an Internet of Things (IoT) controller, one or more processors, and a memory communicatively coupled with, and readable by, the one or more processors and having stored therein processor-readable instructions which, when executed by the one or more processors, cause the one or more processors to perform steps. The IoT controller is to communicatively couple with IoT devices installed in a facility over an IoT network. The steps include to: receive an incident trigger signal generated in response to detecting a gunshot event in the facility in accordance with receiving a gunshot detection signal from a gunshot sensor installed in the facility; execute an automated response plan automatically in response to the incident trigger signal, the executing comprising outputting an IoT control profile to:

generate a plurality of IoT control signals in accordance with the automated response plan; and communicate the IoT control signals to the plurality of IoT devices over the IoT network; and receive an IoT status for the plurality of IoT devices responsive to the plurality of IoT devices operating in accordance with the IoT control signals.

This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

The foregoing, together with other features and embodiments, will become more apparent upon referring to the following specification, claims, and accompanying drawings.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a second label (e.g., a lower-case letter) that distinguishes among the similar components. If only the first reference label is used in the specification, the description is applicable to any one of the similar components having the same first reference label irrespective of the second reference label.

DETAILED DESCRIPTION

Embodiments of the disclosed technology will become clearer when reviewed in connection with the description of the figures herein below. In the following description, numerous specific details are set forth to provide a thorough understanding of the present invention. However, one having ordinary skill in the art should recognize that the invention may be practiced without these specific details. In some instances, circuits, structures, and techniques have not been shown in detail to avoid obscuring the present invention.

When there is a crisis incident in a populated area, there is often a high risk of injury or loss of life. For example, an active shooter incident in a school, office, shopping mall, public park, or other area can put many lives in danger. Coordinating a response to a crisis incident that is rapid, efficient, well-planned, and well-executed can appreciably reduce the likelihood of severe injury and loss of life. However, such a coordinated response can be difficult to implement, particularly when the crisis incident is unexpected, and/or when the first responders are not experts in crisis response.

Embodiments described herein seek to automate crisis incident responses using Internet of Things (IoT) devices and networks. As described herein, embodiments can provide various features. One feature is that some automated crisis incident responses can be performed in a rapid and efficient manner, in accordance with defined automated response plans (or defined parameters for dynamic generation of such response plans) without waiting for, or relying on manual intervention by trained personnel. For example, some embodiments can automatically execute single- or multi-phase plans that involve automating feedback from, and control of, various IoT devices. Another feature is that some automated crisis incident responses can facilitate interaction with emergency responders. For example, some implementations can provide interfaces by which emergency responders can view current status of automated response plan execution and/or of one or more IoT devices; and/or interfaces by which emergency responders can dynamically modify execution of (e.g., and/or completely override some or all of) automated response plans. Implementation of these and other features are described further herein.

Figure 1:
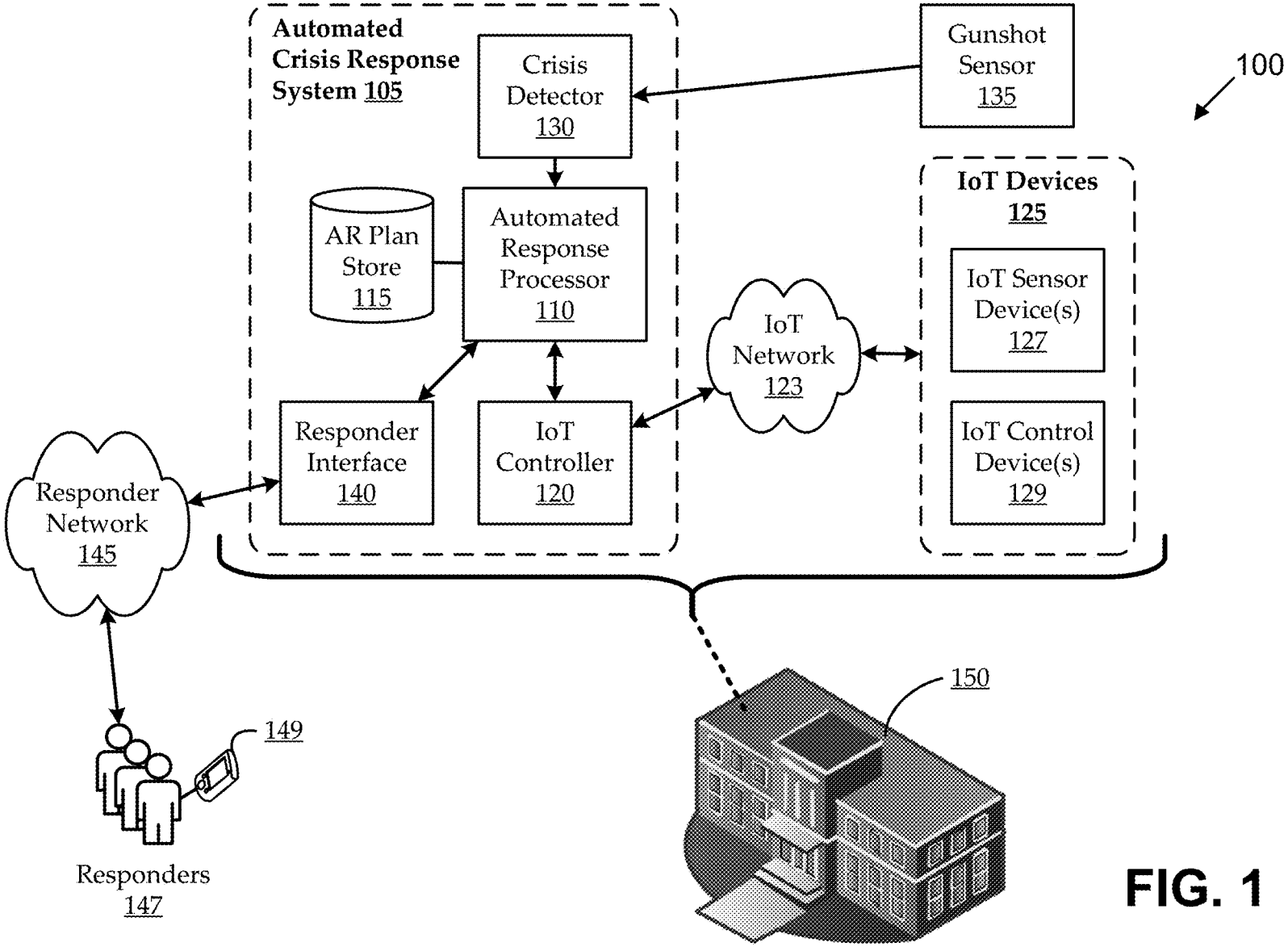
FIG. 1 shows an embodiment of an automated crisis incident response system implemented in context of an illustrative crisis incident environment, according to various embodiments.

FIG. 1 shows an embodiment of an automated crisis incident response system 105 implemented in context of an illustrative crisis incident environment 100, according to various embodiments. The crisis incident environment 100 is illustrated as including a facility 150. Though the facility 150 is shown as a building (e.g., a school or office building), the facility 150 can be any defined indoor and/or outdoor location in which a population in the facility 150 can become victim to a crisis incident occurring in the facility 150. For example, the facility 150 can be a school or office (e.g., including one or more buildings, one or more outdoor spaces, etc.), a residential facility (e.g., an assisted living facility, a dormitory, etc.), a park (e.g., a public park, a playground, a private park, etc.), a home (e.g., including a house and surrounding property), a government building, a public attraction (e.g., a shopping mall, an outdoor public market, a supermarket, a museum, an amusement park, etc.), a restaurant, etc.

Embodiments described herein seek to automate crisis incident responses using Internet of Things (IoT) devices and networks. As illustrated, the facility 150 can have a number of IoT devices 125 installed in different places for different purposes. Some IoT devices 125 can be IoT sensor devices 127, and other IoT devices 125 can be IoT control devices 129. In some cases, a single IoT device 125 can include one or more IoT sensor devices 127 and one or more IoT control devices 129. Some examples of IoT sensor devices 127 include a network-connected temperature sensor (e.g., thermostat, infrared detector, etc.), a network-connected light sensor, a network-connected motion sensor, a network-connected door status sensor (e.g., to detect whether a door is opened, closed and unlocked, closed and locked, etc.), a network-connected camera (e.g., closed-circuit security camera), a network-connected microphone, etc. Some examples of IoT control devices 129 include a network-connected door controller (e.g., to automatically and/or remotely open, close, lock, and/or unlock a door), a network-connected lighting controller (e.g., to automatically and/or remotely turn lights on or off, cause security lights to flash, etc.), a network-connected alarm controller (e.g., to automatically and/or remotely trigger an alarm), a network-connected communications controller (e.g., to automatically and/or remotely enable or disable network communications, contact security personnel, etc.), a network-connected audio controller (e.g., to automatically and/or remotely sound an alarm, emergency message, or other audio, etc.), etc.

The IoT devices 125 are connected with each other and/or with one or more other systems via an IoT network 123. The IoT network 123 can include any suitable network for enabling communications with and/or between the IoT devices 125, including one or more public and/or private network links that are wired and/or wireless. In some embodiments, the IoT network 123 is a low-power, narrow-band network, such as a narrow-band Internet of Things (NB-IoT) network, or a low-power wide area network (LPWAN). Other implementations of the IoT network 123 can include one or more longer range networks, such as long-range wide area networks (LoRaWANs), cellular IoT networks (e.g., Long Term Evolution (LTE); LTE 4G category M (LTE CAT-M); 5G; and other networks); or shorter range networks, such as networks relying on Near Field Communication (NFC), Bluetooth, Zigbee, IEEE 802.11 (WiFi), and/or other protocols and related components.

In any of the above or other types of facilities 150, a crisis incident can occur. As one example, the crisis incident can be an active shooter incident, during which one or more perpetrators enter the facility 150 and begin shooting. During such an incident, other individuals may be present in and around the facility, and those individuals may immediately be shot, or otherwise injured or killed; may attempt to escape to other areas in or away from the facility 150; may attempt to fight back, or otherwise engage the shooters; may attempt to contact emergency responders, or others; etc. As such, over the course of such an event, many parameters can change in dynamic and unpredictable ways, which can impact the effectiveness at various times of different response strategies. Though embodiments are generally described herein with reference to such active shooter types of incidents (e.g., responding to a gunshot detector), the systems and methods described herein can be modified, as appropriate, to respond to other types of crisis incidents.

Figure 2:
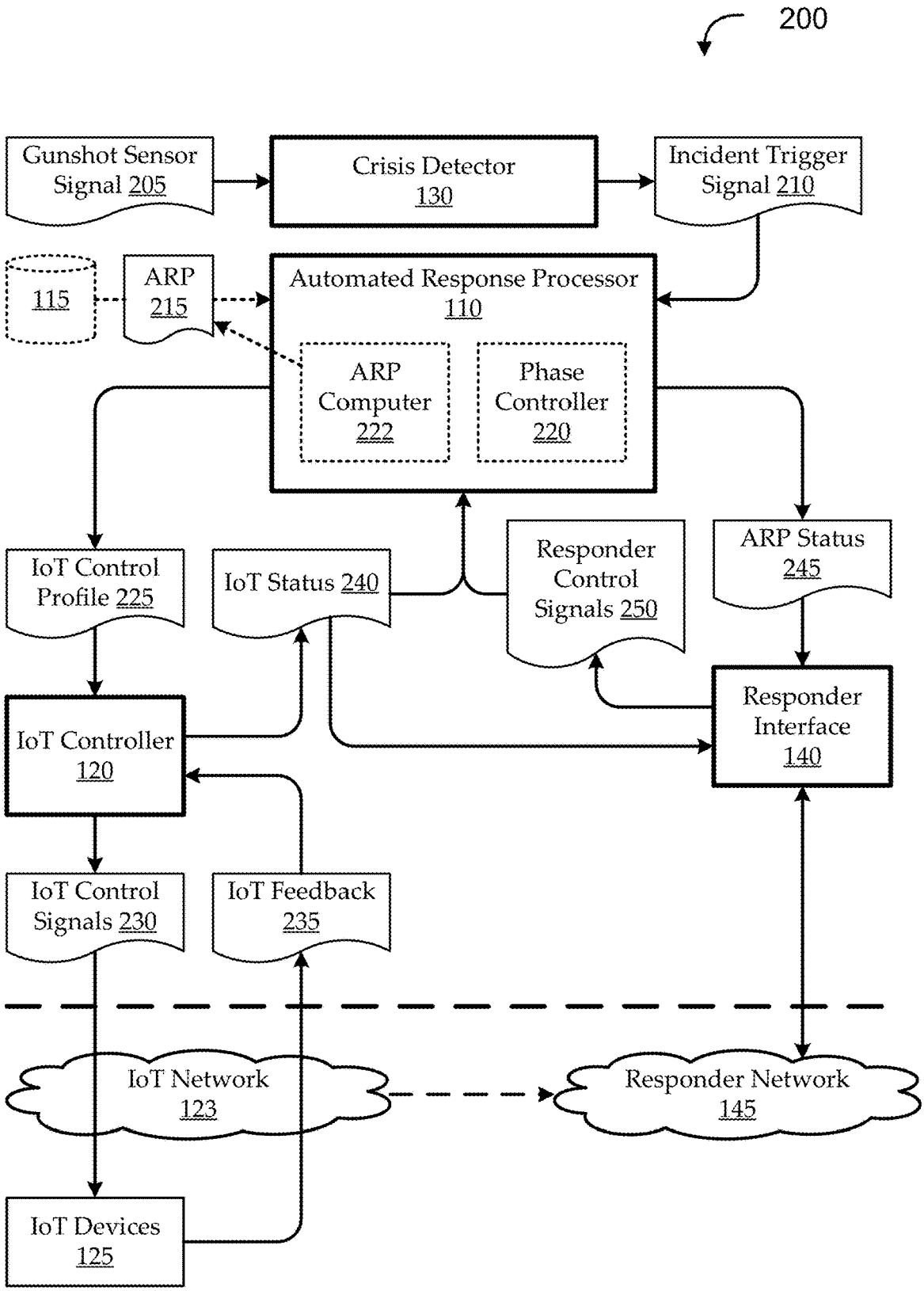
FIG. 2 shows a data flow diagram of an illustrative flow of certain data and communications among the various components of some embodiments of automated crisis incident response systems.

As illustrated, embodiments include an automated crisis incident response system 105. The automated crisis incident response system 105 can include a crisis detector 130, an automated response processor 110, and an IoT controller 120. Some embodiments include other components, such as an automated response plan store 115 and a responder interface 140. FIG. 2 shows a data flow diagram 200 of an illustrative flow of certain data and communications among the various components of some embodiments of automated crisis incident response systems 105. FIGS. 1 and 2 are described concurrently for the sake of added clarity.

Embodiments of the crisis detector 130 can be coupled with a gunshot sensor 135 (e.g., or one or more different type of sensor for automated detection and response in context of other types of crisis incidents). For example, the crisis detector 130 can be in communication with the gunshot sensor 135 via a secure wired communications link, a secure wireless communications link, and/or any other suitable link. In some embodiments, the gunshot sensor 135 is (or is included in) one of more of the IoT devices 125, and is in communication with the crisis detector 130 via the IoT network 123 and/or via a separate network.

The gunshot sensor 135 can include any suitable sensors in any suitable configuration. In some implementations, the gunshot sensor 135 includes acoustic and/or optical sensors and processing components to analyze sensed acoustical and/or optical information, and detect when the analyzed information matches a signature corresponding to gunfire. Some implementations of the gunshot sensor 135 can be configured to provide an estimated location of a detected gunshot. For example, multiple gunshot sensors 135 can be located in different areas of the premises 150, such that a general location of a detected gunshot can be correlated to a known location of the one of the gunshot sensors 135 that detected the gunshot. Alternatively, a single gunshot sensor 135 can include multiple sensors to enable triangulation and location estimation. In some embodiments, the crisis detector 130 receives a gunshot sensor signal 205 from the gunshot sensor 135 that directly indicates that a gunshot event has been detected (e.g., and/or an estimated location of the gunshot event). In other embodiments, the crisis detector 130 receives gunshot sensor signals 205 from the gunshot sensor 135 that include raw or partially processed sensor data, and the crisis detector 130 performs processing and/or analysis to determine whether the received signals correspond to a detected gunshot event. In response to detecting the gunshot event, the crisis detector 130 can output an incident trigger signal 210.

Embodiments of the automated response processor 110 are coupled with the crisis detector 130. In one embodiment, the automated response processor 110 is implemented as a state machine configured to perform an automated routine in response to the incident trigger signal 210 and one or more other inputs, as described herein. In other embodiments, the automated response processor 110 is implemented using one or more processors that are programmed (or hard-coded) to carry out automated crisis incident response functions described herein. As described more fully below, the automated response processor 110 can output an IoT control profile 225 generated automatically in response to the incident trigger signal 210 and in accordance with executing an automated response plan 215. Embodiments of the IoT control profile 225 can define how the various IoT devices 125 installed in and around the premises are to be controlled and/or otherwise exploited in carrying out the automated response plan 215.

The automated response plan 215 can be obtained by the automated response processor 110 in various ways. Some embodiments include an automated response plan store 115, which stores one or more automated response plans 215. For example, personnel (e.g., crisis incident response experts, emergency responders, facility staff, and/or others) can use information about the facility 150, crisis incident response guidelines and experience, and/or other information to develop one or more response plans; and those plans can be coded as automated response plans 215 for storage in the automated response plan store 115. Plans can be coded in any suitable manner. For example, various implementations can permit plans to be coded using plain language (e.g., where the automated response processor 110 includes semantic and/or natural language processing, or the like), using a markup language that can be compiled or otherwise predictably converted into a language readable by the automated response processor 110, using one or more processor-readable programming languages, etc. When only a single automated response plan 215 is stored in the automated response plan store 115, the automated response processor 110 can automatically retrieve that stored plan to use for generating the IoT control profile 225 (e.g., or the stored automated response plan can be, or can include, the IoT control profile 225). When multiple automated response plans 215 are stored in the automated response plan store 115, embodiments of the automated response processor 110 can use additional inputs (e.g., from one or more of the IoT devices 125) to automatically determine which of the automated response plans 215 to select for use in responding to a particular crisis incident.

In other embodiments, the automated response processor 110 can include an automated response plan computer 222 to obtain the automated response plan 215 by automatically computing the automated response plan 215 based on inputs from the IoT devices 125. Implementations of the automated response plan computer 222 can include a state machine, an artificial neural network, a machine learning engine, and/or other suitable components for processing inputs from multiple IoT devices 125, along with other parameters (e.g., fitness functions, or the like), to rapidly and accurately generate the automated response plan 215 and associated IoT control profile 225. As described more fully below, some automated response plans 215 can include multiple phases. Some implementations automatically progress through the phases in accordance with previously defined timing (e.g., a timed sequence of events) and/or in accordance with subsequent data received from one or more IoT devices 125. Other implementations can permit manual switching of phases (e.g., an emergency responder can direct the automated response processor 110 to progress to a next phase, or some selected phase). In embodiments that involve automated computation of an automated response plan 215, the automated computation can, in some embodiments, dynamically update or adjust its computation and its resulting automated response plan 215 in response to changing feedback coming from one or more IoT devices 125.

Embodiments of the IoT controller 120 are coupled with the automated response processor 110. In some embodiments, the IoT controller 120 is implemented by the automated response processor 110, or is a hardware controller or other similar device coupled with the automated response processor 110. For example, on implementation includes a housing that includes the automated response processor 110, the IoT controller 120, and the crisis detector 130 (e.g., and the responder interface 140, as described below), along with ports, antennas, and/or other components to facilitate communicative and/or physical coupling of the automated crisis incident response system 105 with networks, facility 150 structure, etc. The IoT controller 120 can generate IoT control signals 230 automatically in response to the IoT control profile 225, and can communicate the IoT control signals 230 to the IoT devices 125 over the IoT network 123. In some cases, the IoT control signals 230 are simple trigger signals. For example, an IoT control signal 230 may include a simple toggling of voltage level (e.g., from LOW to HIGH, or HIGH to LOW) to actuate a digital input of an IoT device 125 (e.g., causing a light to turn on or off, causing a fire door to close, etc.). In other cases, the IoT control signals 230 can include analog or digital control data streams, analog or digital audiovisual data, and/or other signals. In some implementations, the IoT control signals 230 operate on multiple IoT devices 125 (serially or in parallel) to effect a desired condition. For example, the IoT control signals 230 can control a series of IoT-controlled doors and IoT-controlled emergency lights to provide an escape route for victims of a crisis incident, or to provide a route that controllably distances victims from one or more perpetrators.

Some embodiments of the IoT controller 120 can receive IoT feedback 235 from the IoT devices 125 (e.g., via the IoT network 123) responsive to the IoT devices 125 operating in accordance with the IoT control signals 230. For example, the IoT feedback 235 can indicate whether a change of state occurred (e.g., a light changed from on to off), whether a command was successful, etc. The IoT controller 120 can output an IoT status 240 for the IoT devices 125 in accordance with the IoT feedback 235. In some cases, explicit IoT feedback 235 is not received from some or all of the IoT devices 125, such that some or all of the IoT status 240 is generated by the IoT controller 120 based on its own performance (e.g., whether and when it sent various ones of the IoT control signals 230. Some embodiments of the automated response processor 110 can execute the automated response plan 215 at least partially responsive to the IoT status 240. For example, the automated response plan can define a sequence of events, where some stages of the sequence are triggered by detecting that a prior stage has completed based on IoT status 240. In some implementations, the automated response plan 215 can include one or more conditional steps, contingencies, or the like. For example, the IoT status 240 may indicate that a door, which is supposed to be closed and locked according to the automated response plan 215, has remained open; and the automated response plan 215 may include a contingency to close a different door or perform some other action, accordingly.

Some embodiments of the automated crisis incident response system 105 include a responder interface 140. The responder interface 140 can be coupled with the automated response processor 110 and can facilitate remote interfacing between the automated response processor 110 and one or more responders 147 via a responder network 145. The responders 147 can include any suitable responders to the crisis incident that have some defined authority as responders 147. For example, the responders 147 can include emergency response personnel (e.g., police officers, fire fighters, special weapons and tactics (SWAT) teams, emergency medical technicians, security guards, etc.), trained crisis responders (e.g., professional crisis response teams, personnel affiliated with the facility 150 and trained in crisis response, alarm company personnel, etc.), and/or other suitable responders 147.

The responder network 145 can include any suitable network for communicating with the automated response processor 110 via the responder interface 140. In some embodiments, the responder network 145 is a dedicated, secure network that is separate from all other networks (e.g., from the IoT network 123, from the Internet, from local wireless networks, etc.). For example, the responder interface 140 can include dedicated wired and/or wireless ports that are accessible only to authorized responders 147 and/or authorized responder devices. In some embodiments, the responder network 145 is, or is communicatively coupled with, one or more other networks, such as the Internet, via public and/or private, wired and/or wireless communication links. In some embodiments, the responder network 145 can be communicatively coupled with one or more of the IoT devices 125 directly via the IoT network 123, without going through the responder interface 140 and the automated response processor 110. In some such embodiments, the responder network 145 can only obtain direct access to a particular one or more of the IoT devices 125 (e.g., an internal phone system, an alarm system, etc.); direct communications may only be permitted in one direction; and/or direct communications may be permitted with particular device types, particular credentials, etc.

Different implementations of the responder interface 140 can operate to provide responders 147, via responder interface devices 149, with different types of access to information from, and/or control of, the automated response processor 110. The interface devices 149 can include any suitable devices for viewing information received via the responder interface 140, for instructing the automated response processor 110 via the responder interface 140, and/or for performing other functions enabled via the responder interface 140, as described herein. In some implementations, a responder interface device 149 can be a mobile handheld device (e.g., a smart phone, a tablet computer, a laptop computer, a special-purpose handheld device, etc.), or a mobile station device (e.g., an interface that is part of a mobile command unit in a van, or the like). In other implementations, the responder interface device 149 can be a fixed device. For example, a dedicated interface can be installed in a security office of the facility 150.

In some embodiments, the responder interface 140 is coupled with the automated response processor 110 to output an automated response plan status 245 via the responder network 145 for display on one or more responder interface devices 149 of one or more responders 147. For example, a responder interface device 149 can include wired or wireless connectivity components for communicatively coupling with the responder interface 140. The automated response plan status 245 can then be pushed from the automated response processor 110 to the responder interface device 149 via the responder interface 140 (e.g., automatically in response to the interface device establishing a connection or running a connection routine), or the automated response plan status 245 can be pulled from the automated response processor 110 to the responder interface device 149 via the responder interface 140 (e.g., the responder interface device 149 can issue a request for automated response plan status 245, and the automated response processor 110 can send the requested information in response thereto). The responder interface device 149 can include any suitable display for outputting the automated response plan status 245 in an intelligible format. For example, the responder interface device 149 can include a display screen; visual, audible, and/or tactile indicators, etc. The automated response plan status 245 can indicate (via the responder interface device 149 to the responders 147) any suitable information, such as some or all of the IoT status 240 (e.g., the state of any one or more of the IoT devices 125), changes in IoT status 240 over time, a map or other indication of detected population locations (e.g., a location of one or more perpetrators, one or more victims or potential victims, etc.), progress of a sequential or multi-phase plan deployment (e.g., a list of actions or stages to be carried out, a status of the respective actions or stages, etc.), and/or other information. In some implementations, the automated response plan status 245 can include one or more live feeds from one or more IoT sensor devices 127, such as an audio and/or video feed from a microphone, video camera, infrared camera, etc.

In some embodiments, the responder interface 140 is coupled with the automated response processor 110 to receive responder control signals 250 from the responder interface device 149 via the responder network 145. In such embodiments, execution of the automated response plan 215 by the automated response processor 110 can be at least partially responsive further to the responder control signals 250. When communicatively coupled with the responder interface 140, the responder interface device 149 can display or enable remote controls by which responders 147 can control operation of the automated response processor 110 and/or one or more of the IoT devices 125. As one example, via the responder interface device 149, a responder 147 can issue commands (e.g., instructions, directives, etc.) that are converted by the responder interface device 149 into corresponding responder control signals 250, the responder control signals 250 are converted into IoT control signals 230 by the automated response processor 110 and/or the IoT controller 120, and the IoT control signals 230 direct a door (coupled with an IoT control device 129) to open, close, lock, unlock, etc. As another example, via the responder interface device 149, a responder 147 can similarly direct lights in a particular hallway of the facility 150 to turn on, turn off, begin flashing, etc. As another example, via the responder interface device 149, a responder 147 can similarly take over control of a video display or audio output device to project live or recorded audio and/or video streams into a portion of the facility 150 (e.g., which may involve the automated response processor 110 establishing more of a persistent connection, or the like, between the responder interface device 149 and the IoT devices 125 being taken over).

In some cases, as described above, the automated response plan defines a sequence of multiple plan phases, each phase corresponding to a respective set of interactions with the IoT devices 125. In such cases, the automated response processor 110 can include a phase controller 220. The phase controller 220 can be implemented as a state machine, a controller block of the automated response processor 110, and/or in any other suitable manner. The phase controller 220 can control sequential execution of the multiple plan phases in accordance with the automated response plan 215. Control of the multiple phases can also be responsive to the IoT status 240, for example, indicating successful execution of the multiple plan phases. In some embodiments, the responder interface 140 can facilitate interactions between the responders 147 and the phase controller 220. In one such embodiment, the automated response plan status 245 can further indicate which phase is currently being executed, which phases have successfully been executed, and/or other information about the phases of the automated response plan 215. In other such embodiments, the responder interface device 149 can be used to communicate responder control signals 250 to the automated response processor 110 via the responder network 145 and the responder interface 140, and the sequential execution of the multiple plan phases can be responsive further to the responder control signals 250. For example, a responder 147 can direct the phase controller 220 to proceed to a subsequent phase, to skip a phase, to pause a phase, to re-execute a phase, etc.

Figure 3:
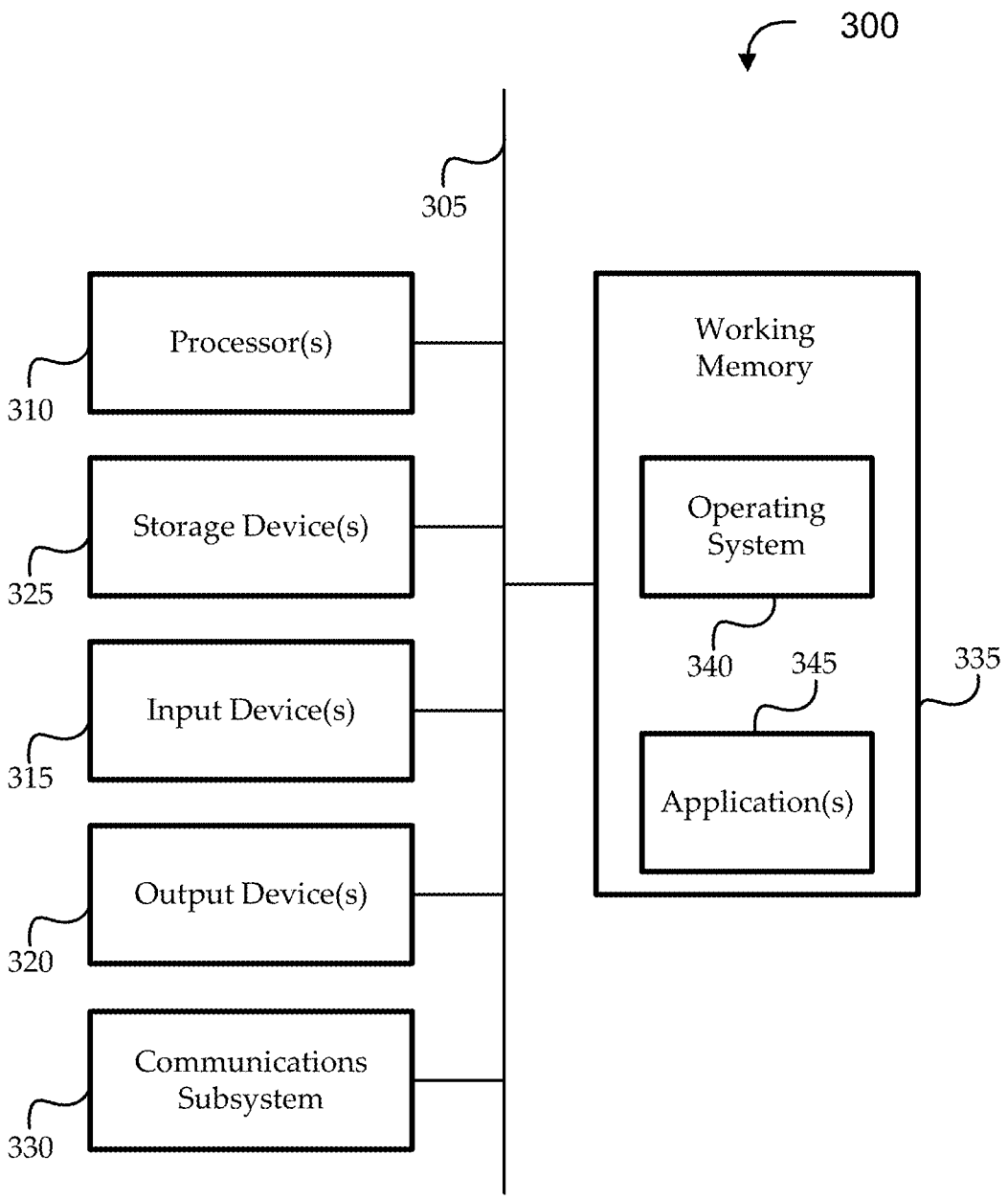
FIG. 3 provides a schematic illustration of one embodiment of a computer system that can perform various steps of the methods provided by various embodiments.

Embodiments of the automated crisis incident response system 105, or components thereof, can be implemented on, and/or can incorporate, one or more computer systems, as illustrated in FIG. 3. FIG. 3 provides a schematic illustration of one embodiment of a computer system 300 that can perform various steps of the methods provided by various embodiments. It should be noted that FIG. 3 is meant only to provide a generalized illustration of various components, any or all of which may be utilized as appropriate. FIG. 3, therefore, broadly illustrates how individual system elements may be implemented in a relatively separated or relatively more integrated manner.

The computer system 300 is shown including hardware elements that can be electrically coupled via a bus 305 (or may otherwise be in communication, as appropriate). The hardware elements may include one or more processors 310, including, without limitation, one or more general-purpose processors and/or one or more special-purpose processors (such as digital signal processing chips, graphics acceleration processors, video decoders, and/or the like); one or more input devices 315, which can include, without limitation, a mouse, a keyboard, remote control, and/or the like;

and one or more output devices 320, which can include, without limitation, a display device, a printer, and/or the like.

The computer system 300 may further include (and/or be in communication with) one or more non-transitory storage devices 325, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable and/or the like. Such storage devices may be configured to implement any appropriate data stores, including, without limitation, various file systems, database structures, and/or the like.

The computer system 300 can also include a communications subsystem 330, which can include, without limitation, a modem, a network card (wireless or wired), an infrared communication device, a wireless communication device, and/or a chipset (such as a Bluetooth™ device, an 802.11 device, a WiFi device, a WiMax device, cellular communication device, etc.), and/or the like. The communications subsystem 330 may permit data to be exchanged with a network (such as the various networks described herein), other computer systems, and/or any other devices described herein. In many embodiments, the computer system 300 will further include a working memory 335, which can include a RAM or ROM device, as described herein.

The computer system 300 also can include software elements, shown as currently being located within the working memory 335, including an operating system 340, device drivers, executable libraries, and/or other code, such as one or more application programs 345, which may include computer programs provided by various embodiments, and/or may be designed to implement methods, and/or configure systems, provided by other embodiments, as described herein. Merely by way of example, one or more procedures described with respect to the method(s) discussed herein can be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or codes can be stored on a non-transitory computer-readable storage medium, such as the non-transitory storage device(s) 325 described above. In some cases, the storage medium can be incorporated within a computer system, such as computer system 300. In other embodiments, the storage medium can be separate from a computer system (e.g., a removable medium, such as a compact disc), and/or provided in an installation package, such that the storage medium can be used to program, configure, and/or adapt a general purpose computer with the instructions/code stored thereon. These instructions can take the form of executable code, which is executable by the computer system 300 and/or can take the form of source and/or installable code, which, upon compilation and/or installation on the computer system 300 (e.g., using any of a variety of generally available compilers, installation programs, compression/decompression utilities, etc.), then takes the form of executable code.

It will be apparent to those skilled in the art that substantial variations may be made in accordance with specific requirements. For example, customized hardware can also be used, and/or particular elements can be implemented in hardware, software (including portable software, such as applets, etc.), or both. Further, connection to other computing devices, such as network input/output devices, may be employed.

As mentioned above, in one aspect, some embodiments may employ a computer system (such as the computer system 300) to perform methods in accordance with various embodiments of the invention. According to a set of embodiments, some or all of the procedures of such methods are performed by the computer system 300 in response to processor 310 executing one or more sequences of one or more instructions (which can be incorporated into the operating system 340 and/or other code, such as an application program 345) contained in the working memory 335. Such instructions may be read into the working memory 335 from another computer-readable medium, such as one or more of the non-transitory storage device(s) 325. Merely by way of example, execution of the sequences of instructions contained in the working memory 335 can cause the processor(s) 310 to perform one or more procedures of the methods described herein.

In some embodiments, the computer system 300 implements an automated crisis incident response system, as described herein, in accordance with instructions stored in working memory 335 and executable by the processor(s) 310. In some such embodiments, the input devices 315, output devices 320, and communications subsystem 330 can be configured to implement an Internet of Things (IoT) controller to communicatively couple, over an IoT network, with multiple IoT devices installed in a facility. The instructions stored in working memory 335 can, when executed by the one or more processors 310, cause the one or more processors 310 to: receive an incident trigger signal generated in response to detecting a gunshot event in the facility in accordance with receiving a gunshot detection signal from a gunshot sensor installed in the facility; execute an automated response plan automatically in response to the incident trigger signal (the executing comprising outputting an IoT control profile to: generate a plurality of IoT control signals in accordance with the automated response plan; and communicate the IoT control signals to the plurality of IoT devices over the IoT network); and receive an IoT status for the plurality of IoT devices responsive to the plurality of IoT devices operating in accordance with the IoT control signals. In some such embodiments, the input devices 315, output devices 320, and communications subsystem 330 can be configured to implement a responder interface to communicatively couple with an interface device (e.g., a remote device of an emergency responder) over a responder network. In such embodiments, the instructions stored in working memory 335 can, when executed by the one or more processors 310, cause the one or more processors 310 further to: output an automated response plan status via the responder network for display on the interface device, the automated response plan status indicating at least a portion of the IoT status; and receive responder control signals from the interface device via the responder network, wherein the executing of the automated response plan is at least partially responsive to the responder control signals.

The terms "machine-readable medium," "computer-readable storage medium" and "computer-readable medium," as used herein, refer to any medium that participates in providing data that causes a machine to operate in a specific fashion. These mediums may be non-transitory. In an embodiment implemented using the computer system 300, various computer-readable media can be involved in providing instructions/code to processor(s) 310 for execution and/or can be used to store and/or carry such instructions/ code. In many implementations, a computer-readable medium is a physical and/or tangible storage medium. Such a medium may take the form of a non-volatile media or volatile media. Non-volatile media include, for example, optical and/or magnetic disks, such as the non-transitory storage device(s) 325. Volatile media include, without limitation, dynamic memory, such as the working memory 335.

Common forms of physical and/or tangible computer-readable media include, for example, a floppy disk, a flexible disk, hard disk, magnetic tape, or any other magnetic medium, a CD-ROM, any other optical medium, any other physical medium with patterns of marks, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 310 for execution. Merely by way of example, the instructions may initially be carried on a magnetic disk and/or optical disc of a remote computer. A remote computer can load the instructions into its dynamic memory and send the instructions as signals over a transmission medium to be received and/or executed by the computer system 300.

The communications subsystem 330 (and/or components thereof) generally will receive signals, and the bus 305 then can carry the signals (and/or the data, instructions, etc., carried by the signals) to the working memory 335, from which the processor(s) 310 retrieves and executes the instructions. The instructions received by the working memory 335 may optionally be stored on a non-transitory storage device 325 either before or after execution by the processor(s) 310.

It should further be understood that the components of computer system 300 can be distributed across a network. For example, some processing may be performed in one location using a first processor while other processing may be performed by another processor remote from the first processor. Other components of computer system 300 may be similarly distributed. As such, computer system 300 may be interpreted as a distributed computing system that performs processing in multiple locations. In some instances, computer system 300 may be interpreted as a single computing device, such as a distinct laptop, desktop computer, or the like, depending on the context.

Figure 4:
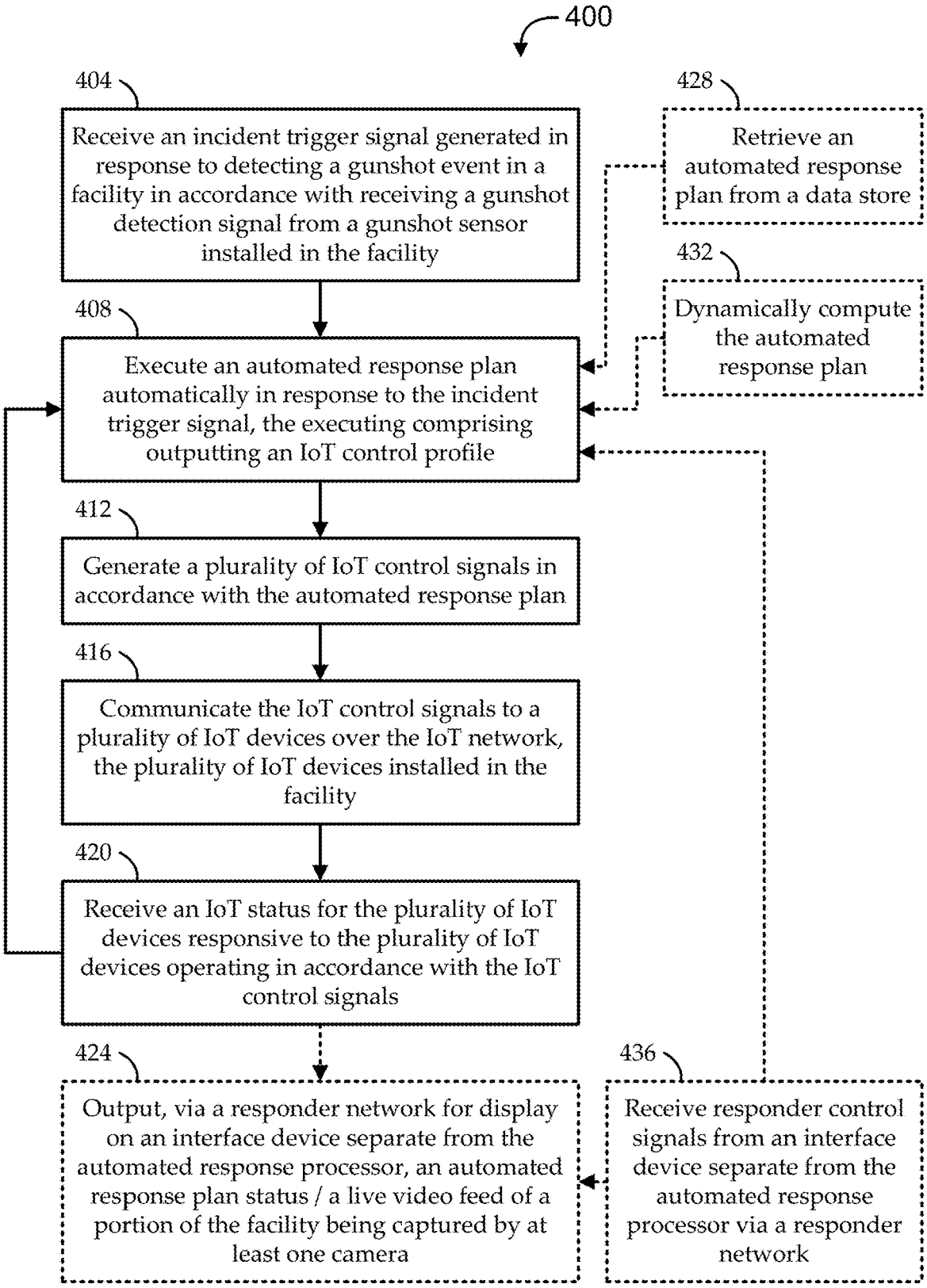
FIG. 4 shows a flow diagram of an illustrative method for automated crisis incident response in Internet of Things networks, according to various embodiments.

Systems including those described above can be used to implement various methods. FIG. 4 shows a flow diagram of an illustrative method 400 for automated crisis incident response in an Internet of Things (IoT) network, according to various embodiments. Some embodiments of the method 400 begin at stage 404 by receiving (e.g., by an automated response processor) an incident trigger signal generated in response to detecting a gunshot event in a facility in accordance with receiving a gunshot detection signal from a gunshot sensor installed in the facility. Though described with specific reference to a gunshot sensor, the method 400 can be modified to respond to one or more other types of crisis incidents.

At stage 408, embodiments can execute (e.g., by the automated response processor) an automated response plan automatically in response to the incident trigger signal. Executing the automated response plan can involve outputting an IoT control profile, which can cause multiple IoT control signals to be generated in accordance with the automated response plan at stage 412, and can cause the IoT control signals to be communicated to multiple IoT devices (installed in the facility) over the IoT network at stage 416. In some implementations, the executing at stage 408, the generating at stage 412, and the communicating at stage 416 are all performed by the automated response processor. In other embodiments, the automated response processor performs the executing at stage 408, and an IoT controller in communication with the automated response processor performs the generating at stage 412 and the communicating at stage 416.

In some embodiments, the IoT profile is generated (e.g., by the automated response processor) prior to being output. In some such embodiments, the IoT control profile is generated automatically at stage 428 in response to the incident trigger signal by: retrieving the automated response plan from a data store, the automated response plan including a set of processor-readable instructions; and generating the IoT control profile to define automated interactions with at least some of the IoT devices in accordance with the set of processor-readable instructions. For example, the automated response plan can be previously created in coordination with emergency response experts, and the automated response plan can be stored in a manner that enables automated execution. As another example, the automated response plan can be one of multiple automated response plans created for different scenarios (e.g., for different types of crisis incidents, for different times of day, in response to different detected IoT status, in response to the crisis incident being detected in different portions of the facility, etc.), and the automated response plan can be stored in a manner that enables automated execution. In other such embodiments, the IoT control profile is generated automatically at stage 432 in response to the incident trigger signal by dynamically computing the automated response plan automatically in response to the incident trigger signal and as a function of obtaining the IoT status responsive to querying the plurality of IoT devices. For example, a state machine, machine learning algorithm, and/or other approach can be used to dynamically generate the automated response plan in accordance with multiple input parameters, such as a detected crisis incident type, detected amounts and/or locations of potential perpetrators and/or victims, detected IoT status, detected crisis incident location with respect to the facility, etc.

At stage 420, embodiments can receive (e.g., by the automated response processor) an IoT status for the IoT devices responsive to the IoT devices operating in accordance with the IoT control signals. As indicated by the arrow between stages 420 and 408, in some embodiments, the executing of the automated response plan at stage 408 can be at least partially responsive to receiving the IoT status. For example, executing the automated response plan at stage 408 can involve performing a sequence of interactions with various IoT devices and verifying successful completion of those interactions; and the receiving of IoT status at stage 420 can indicate which interactions have successfully completed. In some embodiments, the method 400 can, at stage 424, output (e.g., by the automated response processor) an automated response plan status via a responder network for display on an interface device separate from the automated response processor. The displayed automated response plan status can indicating at least a portion of the IoT status. As one example, the displaying can include displaying a live video feed of a portion of the facility being captured by at least one camera (e.g., at least one of the IoT devices). As another example, the displaying can indicate a real-time status of one or more IoT devices, such as indicating a door status (e.g., open, closed unlocked, closed locked, obstructed, etc.), indicating a motion detector status (e.g., recently triggered or not), etc.

Some embodiments of the method 400, at stage 436, can receive responder control signals by the automated response processor from an interface device (e.g., a remote device of an emergency responder). The responder control signals can be used to interact with, and/or direct operation of, functionality of components implementing the method 400. In some implementations, the responder control signals can request an IoT status of one or more IoT devices, view the automated response plan, and/or otherwise monitor operations. For example, the responder control signals received at stage 436 can cause (e.g., direct) the outputting of the automated response plan status via the responder network for display on an interface device at stage 424. In other implementations, the responder control signals received at stage 436 can at least partially direct execution of the automated response plan at stage 408. In one such implementation, during sequential execution of a multi-phase automated response plan, the responder control signals can direct the execution to move to a next phase (e.g., where there one stage to execute prior to the arrival of emergency responders, another stage to execute subsequent to the arrival of emergency responders, etc.). In another such implementation, the responder control signals can direct (e.g., generate, change, override, etc.) the generation of IoT control signals at stage 412 and/or the communication of those signals at stage 416. For example, the responder control signals can direct an IoT facility control device to lock or unlock a particular door, to cause emergency lights to begin flashing, to transfer control of a facility public address system to the interface device, etc.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. An automated crisis incident response system, the system comprising:

an Internet of Things (IoT) network communicatively coupling a plurality of IoT devices installed in a facility, the plurality of IoT devices comprising one or more IoT sensor devices and one or more IoT control devices;

an automated response processor to receive an incident trigger signal indicating at least one of the IoT sensor devices detecting a crisis event presently occurring in the facility, the automated response processor having a phase controller configured to execute, automatically responsive to the incident trigger signal, an automated response plan defining a sequence of plan phases, each corresponding to a respective set of interactions with the plurality of IoT devices;

a responder interface to receive interactions from human responders, and to communicate responder control signals, generated responsive to the interactions, to the automated response processor, the phase controller being configured to execute at least one of the sequence of plan phases based in part on the responder control signals; and an IoT controller, coupled with the automated response processor and the IoT network, to:

generate, for each of the sequence of plan phases automatically responsive to executing by the phase controller of each plan phase of the automated response plan, a plurality of IoT control signals corresponding to the respective set of interactions with the plurality of IoT devices for the plan phase; and communicate the IoT control signals to the plurality of IoT devices over the IoT network.

2. The system of claim 1, further comprising:

an automated response plan store having, stored thereon, a plurality of machine-readable automated response plans, wherein the automated response processor is further to select one of the automated response plans based at least on the crisis event.

3. The system of claim 1, further comprising:

a crisis detector, coupled with the automated response processor and the IoT network, to generate the incident trigger signal in response to the at least one of the IoT sensor devices detecting the crisis event presently occurring in the facility.

4. The system of claim 1, wherein the IoT controller is to generate at least one of the plurality of IoT control signals to change a state of at least one of the IoT control devices.

5. The system of claim 1, wherein the IoT controller is to generate the plurality of IoT control signals further corresponding to feedback information from at least one of the plurality of IoT sensor devices.

6. The system of claim 1, wherein the automated response processor is further to:

dynamically compute the automated response plan automatically in response to the incident trigger signal and as a function of querying the plurality of IoT devices.

7. The system of claim 1, wherein the executing by the phase controller comprises:

receiving, prior to execution of each next plan phase of the sequence of plan phases, a response plan status indicating present data from at least some of the plurality of IoT devices relating to execution of the automated response plan; and executing each next plan phase of the sequence of plan phases in accordance with the response plan status.

8. The system of claim 7, wherein:

the response plan status indicates whether a prior plan phase of the sequence of plan phases is successfully completed; and executing each next plan phase of the sequence of plan phases in accordance with the response plan status comprises executing each next plan phase responsive to the response plan status indicating that the prior plan phase of the sequence of plan phases is successfully completed.

9. The system of claim 1, wherein the responder interface is further to output an automated response plan status via a responder network separate from the IoT network for display on an interface device, the automated response plan status indicating present data from at least some of the plurality of IoT devices.

10. The system of claim 1, wherein the phase controller is a state machine.

11. A method for automated crisis incident response, the method comprising:

receiving, via an Internet of Things (IoT) network, an incident trigger signal indicating a sensor device detecting a crisis event presently occurring in a facility, the facility having, installed therein, a plurality of IoT devices comprising a plurality of IoT control devices and a plurality of IoT sensor devices including the sensor device;

executing, automatically responsive to the incident trigger signal, an automated response plan defining a sequence of plan phases, each corresponding to a respective set of interactions with the plurality of IoT devices;

communicating responder control signals, generated responsive to interactions by human responders via a responder interface the executing of at least one of the sequence of plan phases being based at least in part on the responder control signals; and for each of the sequence of plan phases, automatically responsive to executing by the phase controller of each plan phase of the automated response plan:

generating a plurality of IoT control signals corresponding to the respective set of interactions with the plurality of IoT devices for the plan phase; and communicating the IoT control signals to the plurality of IoT devices over the IoT network.

12. The method of claim 11, further comprising:

selecting, prior to the executing, one of a plurality of stored, machine-readable automated response plans based at least on the crisis event.

13. The method of claim 11, wherein the generating comprises generating at least one of the plurality of IoT control signals to change a state of at least one of the IoT control devices.

14. The method of claim 11, wherein the generating comprises generating the plurality of IoT control signals further corresponding to feedback information from at least one of the plurality of IoT sensor devices.

15. The method of claim 11, wherein the executing comprises:

receiving, prior to execution of each next plan phase of the sequence of plan phases, a response plan status indicating present data from at least some of the plurality of IoT devices relating to execution of the automated response plan; and executing each next plan phase of the sequence of plan phases in accordance with the response plan status.

16. The method of claim 15, wherein:

the response plan status indicates whether a prior plan phase of the sequence of plan phases is successfully completed; and executing each next plan phase of the sequence of plan phases in accordance with the response plan status comprises executing each next plan phase responsive to the response plan status indicating that the prior plan phase of the sequence of plan phases is successfully completed.

17. The method of claim 11, further comprising:

outputting an automated response plan status via a responder network separate from the IoT network for display on an interface device, the automated response plan status indicating present data from at least some of the plurality of IoT devices.

18. The method of claim 11, wherein the executing further comprises:

dynamically computing the automated response plan automatically in response to the incident trigger signal and as a function of querying the plurality of IoT devices.

* * * * *